United States Patent [19]

Yamamoto

[11] 4,265,056

[45] May 5, 1981

[54] ELECTRIC CAN-OPENER WITH KNIFE SHARPENER

[75] Inventor: Osamu Yamamoto, Nagoya, Japan

[73] Assignee: Kabushikikaisha, Japan

[21] Appl. No.: 39,928

[22] Filed: May 17, 1979

[30] Foreign Application Priority Data

May 17, 1978 [JP] Japan ..... 53-58457

[51] Int. Cl.[3] ..... B24B 45/00

[52] U.S. Cl. ..... 51/128; 51/168; 51/181 R

[58] Field of Search ..... 51/128, 168, 181 R, 51/268, 426

[56] References Cited

U.S. PATENT DOCUMENTS

| | | | |
|---|---|---|---|
| 2,187,350 | 1/1940 | Kuzmick | 51/168 |
| 2,259,345 | 10/1941 | Kuzmick | 51/168 X |
| 2,735,247 | 2/1956 | Holzhausen | 51/168 X |
| 2,755,605 | 7/1956 | Simmons | 51/168 |
| 3,146,555 | 9/1964 | Posener | 51/128 |
| 3,466,811 | 9/1969 | Suddarth | 51/268 X |
| 3,599,375 | 8/1971 | Nunemaker | 51/426 |
| 3,879,178 | 4/1975 | Bosma | 51/168 |

*Primary Examiner*—Gary L. Smith
*Attorney, Agent, or Firm*—William A. Drucker

[57] ABSTRACT

A rear wall is detachably fitted at the rear of a body frame. A grinding wheel casing is also associated at the rear of the rear wall. A feeder wheel disposed on the front surface of the body frame and a rotatable grinding wheel provided within the grinding wheel casing are respectively rotated by a motor provided within the body frame. A cutter disposed opposite the feeder wheel cuts open a lid of a can rotated by the feeder wheel. The rotatable grinding wheel provided within the grinding wheel casing sharpens the edge of a knife inserted into the grinding wheel casing from a slit formed in a portion of the grinding wheel casing.

4 Claims, 8 Drawing Figures

ELECTRIC CAN-OPENER WITH KNIFE SHARPENER

BACKGROUND OF THE INVENTION

1. Field of the Invention

This invention relates to an electric can-opener incorporating a grinding mechanism adapted to sharpen kitchen knives or knives used in general households.

2. Description of the Prior Art

In an electric can-opener of the type as described, the above-mentioned grinding mechanism comprises a grinding wheel spindle rotated by a motor and a rotatable grinding wheel mounted on the grinding wheel spindle.

A construction for mounting the rotatable grinding wheel on the grinding wheel spindle heretofore known is the following. In this known construction, that is, the grinding wheel spindle is preformed with a flange and external threads, the grinding wheel spindle is inserted into an axial hole of the rotatable grinding wheel, and the grinding wheel is tightened by the flange and a nut screwed on the external threads. In the case of such a construction, mounting of the rotatable grinding wheel on the grinding wheel spindle becomes very rigid. Accordingly, when a knife is urged against the rotatable grinding wheel in order to sharpen said knife, the knife must be carefully urged thereagainst by a suitable force so as to avoid an excessive depression. The reason is that excessive depression causes a stoppage of rotation of the rotatable grinding wheel, resulting in a stoppage of rotation of the grinding wheel spindle so that the motor which drives the grinding wheel spindle becomes burnt, which has to be avoided.

Another reason is that even if the excessive depression noted above does not result in a stoppage of rotation of the grinding wheel, the knife is partly sharpened due to application of such excessive depression thereto so that an uneven sharpness occurs, which has to be avoided.

SUMMARY OF THE INVENTION

It is therefore an object of the present invention to provide an electric can-opener provided with a grinding mechanism of the construction wherein even if a rotatable grinding wheel has been placed in a state where rotation thereof is stopped by a frictional resistance between an article to be sharpened and the rotatable grinding wheel resulting from the excessive depression of the article to be sharpened against the rotatable grinding wheel, a slip is produced between a grinding wheel spindle and the rotatable grinding wheel to permit rotation of the grinding wheel spindle to continue, whereby a motor to which the grinding wheel spindle is connected is prevented from being locked, thus avoiding a burning failure of the motor.

It is another object of the present invention to provide an electric can-opener provided with a grinding mechanism of the construction wherein in the case the force for urging the article to be sharpened against the rotatable grinding wheel is excessive as described above, the rotation of the rotatable grinding wheel can be stopped to prevent the article to be sharpened from being partially excessively sharpened to obtain an even ground surface.

It is a further object of the present invention to provide an electric can-opener provided with a grinding mechanism of the construction wherein even if there is produced a slip between the rotatable grinding wheel and the grinding wheel spindle inserted into the axial hole of the rotatable grinding wheel, the outer peripheral surface of the grinding wheel spindle is not ground by the coarse inner peripheral surface of the rotatable grinding wheel, in other words, if the resistance more than as needed is applied to the rotatable grinding wheel, a slip is produced between the grinding wheel spindle and the internal surface of the rotatable grinding wheel, thus providing the effect as described above.

DESCRIPTION OF THE PREFERRED EMBODIMENTS

Figure 1:
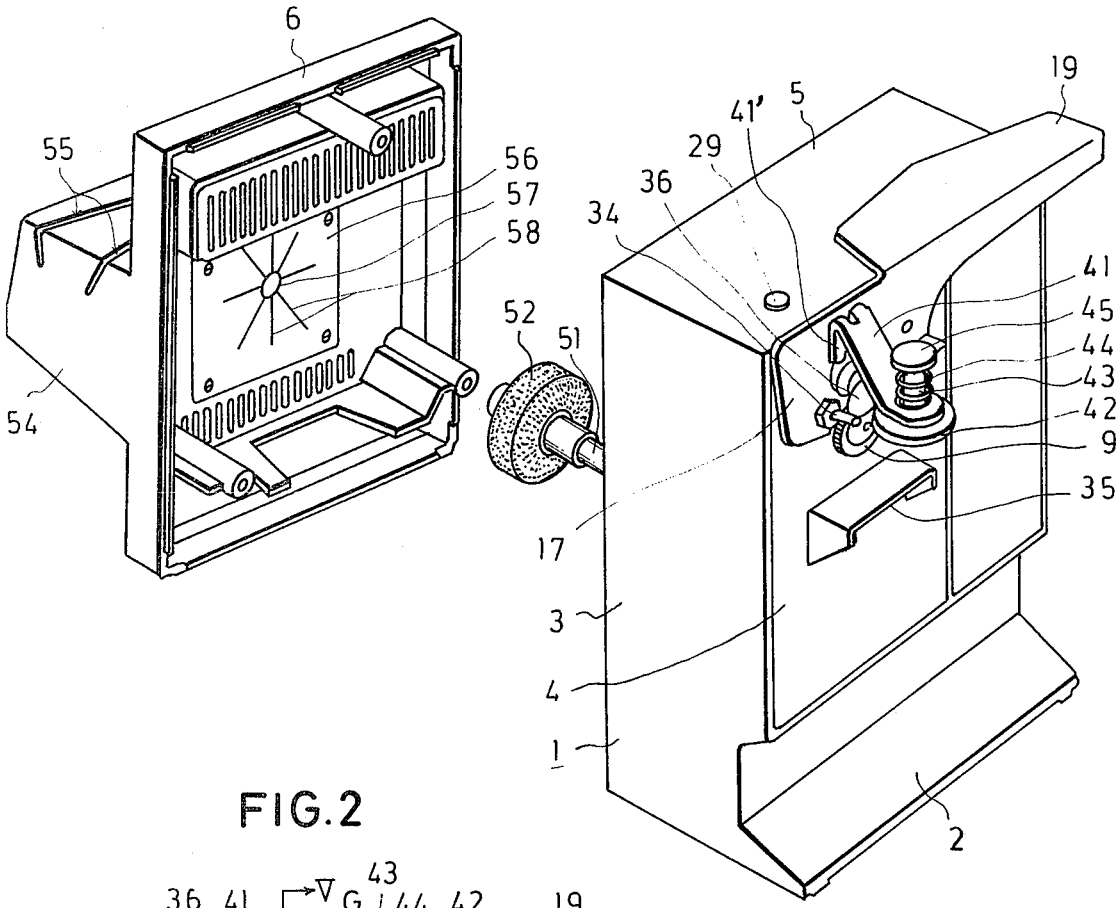
FIG. 1 is a perspective view showing a state where a rear wall is disengaged.

Referring to figures, a body frame 1 is composed of a base member 2, side walls 3, a front wall 4, and a top plate 5. The body frame 1 further has a rear wall 6 detachably covered thereon to form a hollow chamber therebetween. In a bearing member 7 carried by the front wall 4 is rotatably inserted a shaft 8 of a can feeding device F which is described below and a feeder wheel 9 with small cogs on its periphery is screwed to the outer end of said shaft, a big gear 10 being fixed to the inner end of said shaft. The latter gear 10 is connected mechanically to an armature shaft of an electric motor M through a gear 15 and 12 carried by the shaft 11 and so on and is driven to rotate the feeder wheel 9 in a direction (shown by an arrow 16) when the electric motor M is connected to a power source and a voltage is applied to a coil M'.

Next, in a cutter operating mechanism G, a movable frame 17 is pivotally supported by a shaft 18 so as to rotate in a direction parallel to the front wall 4 the free end portion of said movable frame being provided integrally with a handle 19 formed to hang over a part of the top plate 5. Said shaft 18 is received rotatably and removably in a bearing member 7' passing through the body frame 1, the inner end portion 20' of the shaft 18 being shaped in the form substantially of a cone and the intermediate portion 20'' being provided with an engage groove 21.

Figure 5:
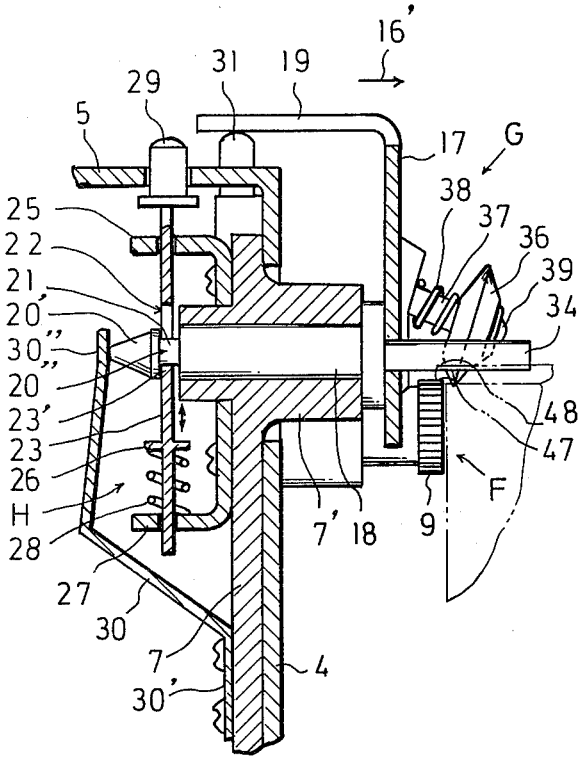
FIG. 5 is a sectional view taken along line V—V of FIG. 2.

On the other hand, in a holding mechanism H, an engage piece 23 with a through hole 22, which is situated on the prolonged axis of the shaft 18 in the case of insertion of said shaft 18, is provided so that the piece may reciprocate in a direction crossing said prolonged axis and the upper portion of said piece 23 is supported by a support 25. This engage piece 23 is usually biased towards a push button 29 which is mounted on the upper end of said piece 23, by means of a spiral spring 28 which is compressingly inserted between a spring holder 26 extending from said piece and a spring seat 27 extending from the side of the body frame 1 and when the shaft 18 is to be inserted into the through hole 22, the apex 20' of the shaft 18 is forced in said through hole 22 to lower the engage piece 23. Being further forced, the shaft 18 pushes the free end portion 30'' of a spring plate 30, whose one end 30' is connected to the body frame and whose other end 30'' is resiliently movable along the axis of the shaft 18 to the position of the apex 20' shown in FIG. 5, and an arrangement shown in FIG. 5 is attained. In this case, of course, the engage piece 23 enters the groove 21, preventing the shaft 18 from escaping freely in the axial direction. Thus, when the shaft 18 is to be drawn out the engage edge 23' of the engage piece 23 is disengaged from the groove 21 by one motion of pushing down the button 29 and at the same time the movable frame 17 and the shaft 18 are pushed out in the direction of the arrow head 16' by the biasing force of the spring plate 30 acting towards the shaft 18, the shaft 18 being in turn caught in a situation where the movable frame 17 is easily removed.

Next, guide members 34 and 34' extending from the movable frame 17 are both for preventing the undesirable movement of a can in opening work by tightly contacting the top of the can with said guide members, the member 34 being formed on the axis of the movable frame 17 integrally therewith, the member 34' being overlappingly fixed on the rear surface of the movable frame 17 and both members extending farther than the feeder wheel 9 as shown in FIG. 5. A projection 35 which is carried by the front wall 4 and extends outwards therethrough is for receiving the body of a can somewhat obliquely and is extending farther than the feeder wheel thereunder. A round cutter 36 having edges on its outer periphery is rotatably supported around a shaft 37 which extends in the oblique downward direction from the movable frame 17 and is usually disposed in the forward direction by means of a compression spring 38 which is inserted between the cutter 36 and the root portion of the shaft 37. The slip out of the cutter 36 is prevented by screwing a bolt with a large head 39 into the shaft 37. Further, a bifurcated arm 41, of which one branch 41' is removably secured to the movable frame 17 by a mounting pin 40, is for holding a magnet piece 42 to attract the lid cut off from a can allowing said piece to move up and down and there is secured the magnet piece 42 at the lower end of a suspender 43 which is inserted in a through hole bored at the end of said arm. Numeral 44 is a compression spring and numeral 45 is a stopping member.

A switching button 31, which is mounted on the top plate 5 so that it may protrude and sink freely, is situated at the position where the button 31 can contact with the lower surface of the handle 19 and is caused to sink to actuate a movable contact 32 which is adapted to cooperate with the button 31, thereby energizing the electric motor M. The movable contact 32 and a fixed one 32' are both attached to an insulating supporter plate 33 formed on the body frame and are electrically connected to a circuit energizing the electric motor M.

Figure 2:
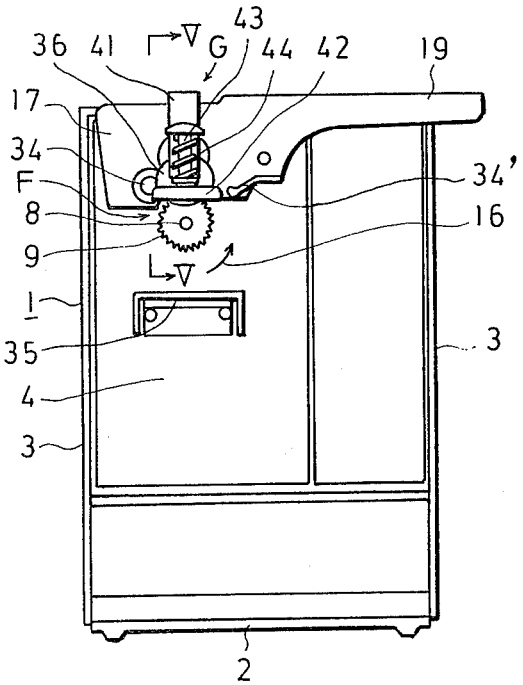
FIG. 2 is a front view.
Figure 3:
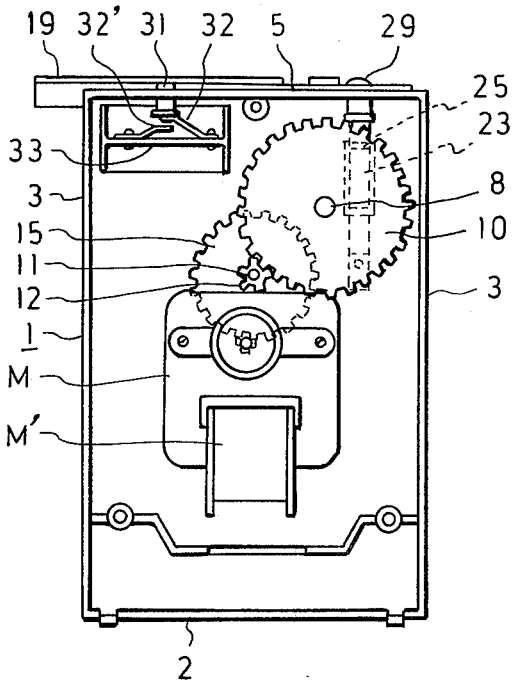
FIG. 3 is a back view showing the interior with the rear wall removed.
Figure 4:
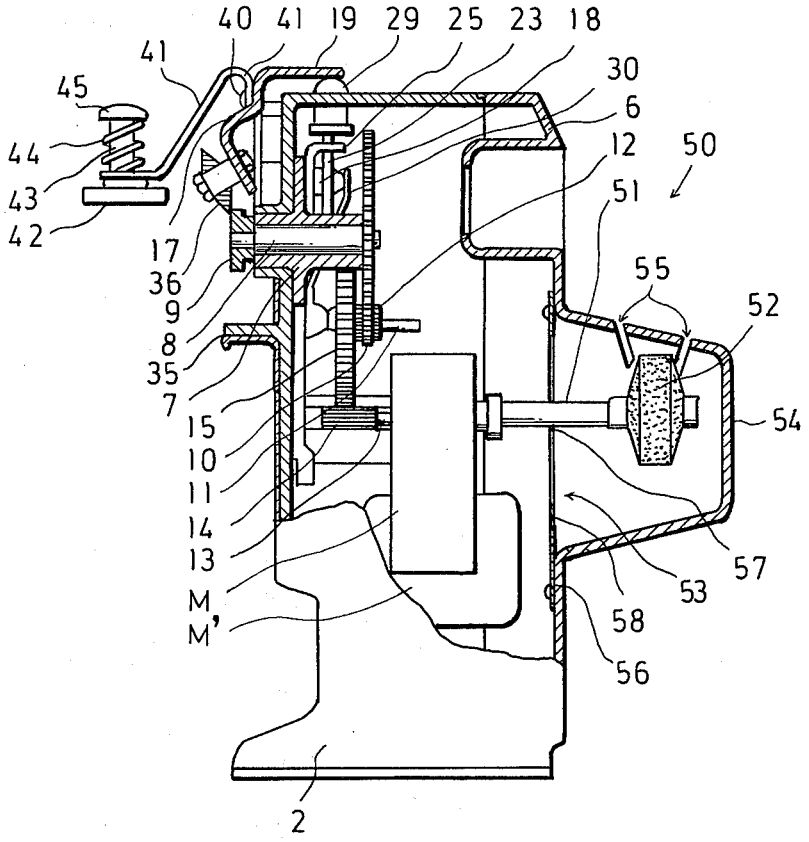
FIG. 4 is a partially cutaway side view.

The operation of the device constructed as mentioned above is as follows. When the handle 19 disposed at the position shown in FIG. 1 is raised, the edge 47 of the top of the can is placed on the feeder wheel 9 and then the handle 19 is lowered, the cutter 36 cuts into the top of the can near the outer periphery 48, the switch composed of contacts 32 and 32' closes and the electric motor M is energized to rotate the feeder wheel 9. Accordingly, the feeder wheel 9 and the cutter 36 rotate in a situation shown in FIGS. 2, 4 and 5 and the latter cuts the top of the can at the outer periphery, the can itself being rotated. The lid of the can cut off from the can body is drawn by the magnet piece 42 to be held and is prevented from falling into the can.

When it is necessary to take away the cutter after the opening operation or a can containing canned fruits such as oranges need be opened after a can containing fat such as lard has been opened and movable frame 17 and the shaft 18 are both forced forward by the spring plate 30 when the button 29 is pushed down and the shaft 18 remains still in the bearing member 7' and is held there without falling down in a situation where it can be easily taken away. As the result, it is possible to wash the contaminated members such as the cutter 36 quite separately from the body frame 1 by grasping the handle 19 and taking this away. In this case, it is, of course, unnecessary for the operator to touch the contaminated portions and moreover all operations can be effectuated with one hand.

Next, a grinding mechanism arranged on the rear surface of the body frame 1 will be described. A grinding wheel spindle 51 is inserted into an opening 53 bored in the rear wall 6. The grinding wheel spindle 51 positioned within the body frame 1 has one end connected to a rotatable shaft 13 of the electric motor M. On the other hand, on the other end extended from the opening 53 is mounted a rotatable grinding wheel 52 in a manner later described. This grinding wheel 52 is covered with a grinding wheel casing 54 formed integral with the rear wall 6. These rear wall 6 and grinding wheel casing 54 are formed at the same time of a material of plastic by use of the molding dies. The grinding wheel casing 54 is formed with knife receiving grooves 55 so as to receive a knife therein. The knife inserted into the groove 55 will have its edge sharpened at an adequate angle while the side thereof is placed in contact with the side of the grinding wheel 52. The opening 53 of the rear wall 6 is closed by a diaphragm 56 formed of a flexible material. Material used to form the diaphragm 56 includes an elastic material, for example, such as polyprophylene and nylon. The diaphragm 56 has a through hole 57 formed in a central portion thereof into which the grinding wheel spindle 51 is inserted. The through hole 57 has its size designed so that the inner peripheral surface thereof exactly comes into contact with the grinding wheel spindle 51, or its size designed so that a so small clearance as not to permit passage of ground chips therethrough is formed between the inner peripheral surface and the grinding wheel spindle 51. The diaphragm 56 is further formed with a plurality of breaks 58. These breaks 58 enable the grinding wheel 52 to pass through the flexed peripheral edge of the through hole 57. With this, even in a state where the grinding wheel 52 remains mounted on the grinding wheel spindle 51, the rear wall 6 may be freely installed or detached from the body frame.

Figure 7:
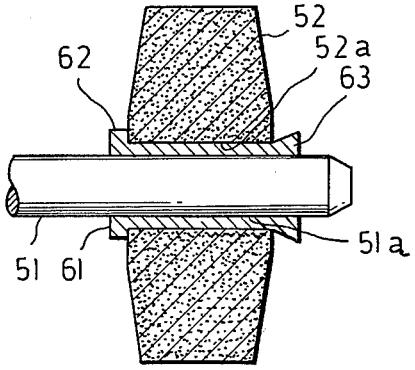
FIG. 7 is a sectional view showing the relationship between a grinding wheel spindle and a rotatable grinding wheel.
Figure 6:
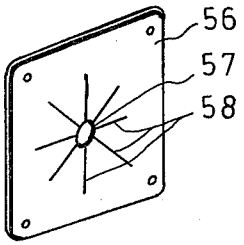
FIG. 6 is a perspective view of a diaphragm.

Next, FIG. 7 shows a construction for mounting the rotatable grinding wheel 52 on the grinding wheel spindle 51. That is, a cylindrical bush 61 is interposed between an outer peripheral surface 51*a* of the grinding wheel spindle 51 and an axial hole 52*a* of the rotatable grinding wheel 52. The bush 61, which is formed of an elastic material such as rubber, has an inner peripheral surface resiliently urged against the outer peripheral surface 51*a* of the grinding wheel spindle 51 whereas an outer peripheral surface thereof is urged against the axial hole 52*a* of the grinding wheel 52. In this state, the grinding wheel spindle 51 and the rotatable grinding wheel 52 are concentrically maintained. The bush 61 has a flange 62 at one end thereof and an engage portion 63 at the other end thereof to prevent movement of the rotatable grinding wheel 52 in an axial direction thereof.

Figure 8:
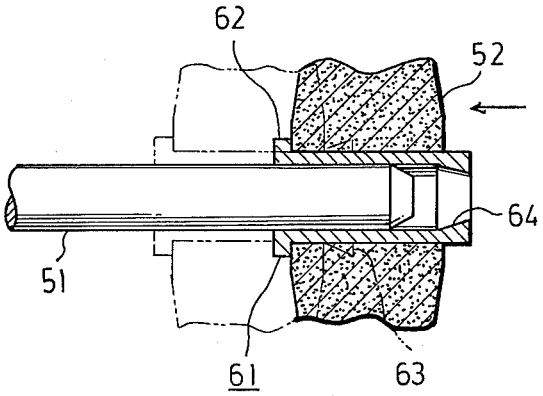
FIG. 8 is a sectional view showing a state before the rotatable grinding wheel is secured to the grinding wheel spindle.

Locking of the rotatable grinding wheel 52 to the grinding wheel spindle 51 as shown in FIG. 7 may be carried out in the procedure as shown in FIG. 8. That is, the bush 61 is machined so as to have its internal diameter slightly smaller than the diameter of the grinding wheel spindle 51 and to have its external diameter which can be inserted loosely (not tightly) into the axial hole 52*a* of the grinding wheel 52. Further, the bush 61 is shaped to have a flange 62 at one end thereof and a circumferential convex edge 64 at only the inner peripheral surface of the other end thereof.

In operation of mounting the rotatable grinding wheel 52 on the grinding wheel spindle 51, the bush 61 is first inserted into the axial hole 52*a* of the rotatable grinding wheel 52, and then the grinding wheel spindle 51 is inserted inside of the bush 61. The grinding wheel spindle 51 may be inserted into the bush 61 after alcohol is coated on the end of the grinding wheel spindle 51. The insertion of the spindle 51 may be effected up to a point of predetermined dimension using a jig and a press device (which are not shown).

By insertion of the grinding wheel spindle 51 into the bush 61 as described above, the inner peripheral surface of the bush 61 is placed in intimate contact with the outer peripheral surface 51*a* of the grinding wheel spindle 51, and the bush 61 is also enlarged in diameter so that the outer peripheral surface thereof is placed in intimate contact with the axial hole 52*a* of the grinding wheel 52. Also, the inner peripheral convex edge 64 is enlarged by the spindle 51 so that the engage portion 63 is expanded.

Where the knife bears on the rotatable grinding wheel 52 mounted on the grinding wheel spindle 51 as described above to sharpen the same, when the knife is excessively urged against the grinding wheel 52, the rotatable grinding wheel 52 becomes stopped by the frictional force between said grinding wheel and the knife. However, the slip is produced between the bush 61 and the grinding wheel spindle 51 so that the grinding wheel spindle is never stopped. Accordingly, a failure of burning the electric motor M can be prevented.

In addition, in this case, since the rotatable grinding wheel 52 becomes stopped as described above, excessive sharpening of the knife can also be prevented.

What is claimed is:

1. In a can opener including an electric motor and a spindle coupled for rotation to said motor and carrying a knife grinding wheel, the improvement which comprises, in combination:

(i) said spindle has a portion, extending from a free end thereof, which has a cylindrical outer periphery, (ii) said grinding wheel has an axial hole the internal periphery of which is cylindrical and of greater diameter than the outer periphery of the spindle, (iii) a one-piece bush composed wholly of resiliently deformable material is disposed in and extends at each end from the axial hole of the grinding wheel, and is engaged upon said spindle portion, said bush including a sleeve having its external periphery cylindrical and of a diameter, in the unconstrained state of the bush, less than the diameter of the internal periphery of the grinding wheel hole, said sleeve having its internal periphery cylindrical and of a diameter, in the unconstrained state of the bush, less than the diameter of the outer periphery of the spindle, said bush having at a first end thereof a radially-outwardly projecting flange of external diameter greater than the diameter of the internal periphery of the grinding wheel hole, said bush having at a second end thereof a rib which, in the unconstrained state of the bush, is radially-inwardly projecting and of a diameter less than that of the internal periphery of the bush, whereby upon insertion of said bush in its unconstrained state into the hole of the grinding wheel with the flange at one side of the grinding wheel, and thereafter forcing said bush onto said spindle, said rib abuts against the spindle and is expanded with resilient deformation to become a radially-outwardly directed rib at the other side of the grinding wheel, the dimensions of said inwardly projecting rib being made such that after deformation said radially-outwardly rib is of diameter greater than the diameter of the internal periphery of the grinding wheel hole.

2. A can opener, as claimed in claim 1, wherein said radially-inwardly projecting rib is frusto-conically tapered in the axial direction towards the adjacent end of the bush.

3. A can opener, as claimed in claim 1, wherein said portion of the spindle is frusto-conically tapered in the axial direction towards the free end thereof.

4. A can opener, as claimed in claim 2, wherein said portion of the spindle is frusto-conically tapered in the axial direction towards the free end thereof.

* * * * *

UNITED STATES PATENT AND TRADEMARK OFFICE

CERTIFICATE OF CORRECTION

PATENT NO. : 4,265,056

DATED : May 5, 1981

INVENTOR(S) : Osamu Yamamoto

It is certified that error appears in the above—identified patent and that said Letters Patent is hereby corrected as shown below:

On The Title Page, the assignee should read

-- (73) Assignee: Kabushikikaisha Aichidenkikosakusho, Japan --.

Signed and Sealed this

*Twenty-second* Day of *December 1981*

[SEAL]

*Attest:*

GERALD J. MOSSINGHOFF

*Attesting Officer*

*Commissioner of Patents and Trademarks*